US009952011B2

(12) United States Patent
Overstreet et al.

(10) Patent No.: US 9,952,011 B2
(45) Date of Patent: Apr. 24, 2018

(54) ROTATIONALLY ACTUATED AND DUAL PIN SUPPORTED LINKAGE INCORPORATED INTO A LOWER RECEIVER OF A FIREARM FOR ESTABLISHING A LAST SHOT HOLD OPEN CONDITION WITH AN UPWARDLY DISPLACEABLE MAGAZINE FOLLOWER

(71) Applicant: 22 Evolution LLC, Columbia, MO (US)

(72) Inventors: John L. Overstreet, Fayette, MO (US); Tyson Bradshaw, Kirksville, MO (US); Von Davis, Columbia, MO (US); Jordan Wilson, Columbia, MO (US)

(73) Assignee: 22 Evolution LLC, Columbia, MO (US)

( * ) Notice: Subject to any disclaimer, the term of this patent is extended or adjusted under 35 U.S.C. 154(b) by 0 days.

(21) Appl. No.: 15/366,771

(22) Filed: Dec. 1, 2016

(65) Prior Publication Data

US 2017/0160032 A1 Jun. 8, 2017

Related U.S. Application Data

(60) Provisional application No. 62/263,485, filed on Dec. 4, 2015.

(51) Int. Cl.
*F41A 17/36* (2006.01)
*F41A 3/66* (2006.01)

(52) U.S. Cl.
CPC ..... *F41A 17/36* (2013.01); *F41A 3/66* (2013.01)

(58) Field of Classification Search
CPC ..... F41A 17/36
USPC ..... 42/70.02
See application file for complete search history.

(56) References Cited

U.S. PATENT DOCUMENTS 3,098,311 A * 7/1963 Savioli ..... F41A 17/36 42/18
3,688,640 A 9/1972 Seecamp
3,846,928 A * 11/1974 Ruger ..... F41A 17/36 42/16

(Continued)

FOREIGN PATENT DOCUMENTS

GB 422675 A 1/1935

*Primary Examiner* — Stephen Johnson
(74) *Attorney, Agent, or Firm* — Dinsmore & Shohl LLP

(57) ABSTRACT

A bolt hold open linkage incorporated into a lower receiver of a firearm for elevating a bolt catch into contact with a forwardly displacing bolt associated with an upper receiver reciprocating action assembly. An elongated central stem has a forward end and an opposite rearward end, a shoulder being supported, via an extending portion, from the rearward end. A pair of axially aligning mounting pins are supported at spaced apart locations of the lower receiver above a magazine receiving well incorporated into the lower receiver, the pins mounting the opposite ends in pivoting fashion about a centerline extending between the axially aligning pins which is offset from the shoulder. Upon an upwardly displaceable follower, associated with a magazine which is secured to the well, being adapted to elevate into contact with the linkage at a location offset from the axial centerline, the shoulder actuating in a combined pivoting and elevating fashion and adapted to contact and elevate the bolt catch for intercepting the forwardly displacing bolt.

19 Claims, 18 Drawing Sheets

(56) References Cited

U.S. PATENT DOCUMENTS

| | | | | |
|---|---|---|---|---|
| 4,128,042 | A | 12/1978 | Atchisson | |
| 4,455,919 | A | 6/1984 | Osborne et al. | |
| 6,510,778 | B1 | 1/2003 | Irwin | |
| 7,661,219 | B1 | 2/2010 | Knight, Jr. et al. | |
| 8,327,749 | B2 | 12/2012 | Underwood | |
| 8,387,296 | B2 | 3/2013 | Overstreet et al. | |
| 8,479,635 | B2 | 7/2013 | Overstreet et al. | |
| 8,572,875 | B2 | 11/2013 | Sisgoid | |
| 8,695,477 | B2 | 4/2014 | Esch | |
| 8,984,786 | B2 | 3/2015 | Underwood | |
| 9,091,499 | B2 | 7/2015 | Overstreet et al. | |
| 2005/0000138 | A1 | 1/2005 | Kiss | |
| 2013/0014416 | A1 | 1/2013 | Sisoold | |
| 2014/0060310 | A1 | 3/2014 | Overstreet et al. | |
| 2014/0215880 | A1* | 8/2014 | Zukowski | F41A 17/36 42/70.02 |
| 2015/0198400 | A1 | 7/2015 | O'Dell | |
| 2015/0260481 | A1 | 9/2015 | Sugg et al. | |
| 2015/0362270 | A1 | 12/2015 | Stewart et al. | |
| 2016/0116242 | A1 | 4/2016 | McGinty | |

* cited by examiner

FIG. 7
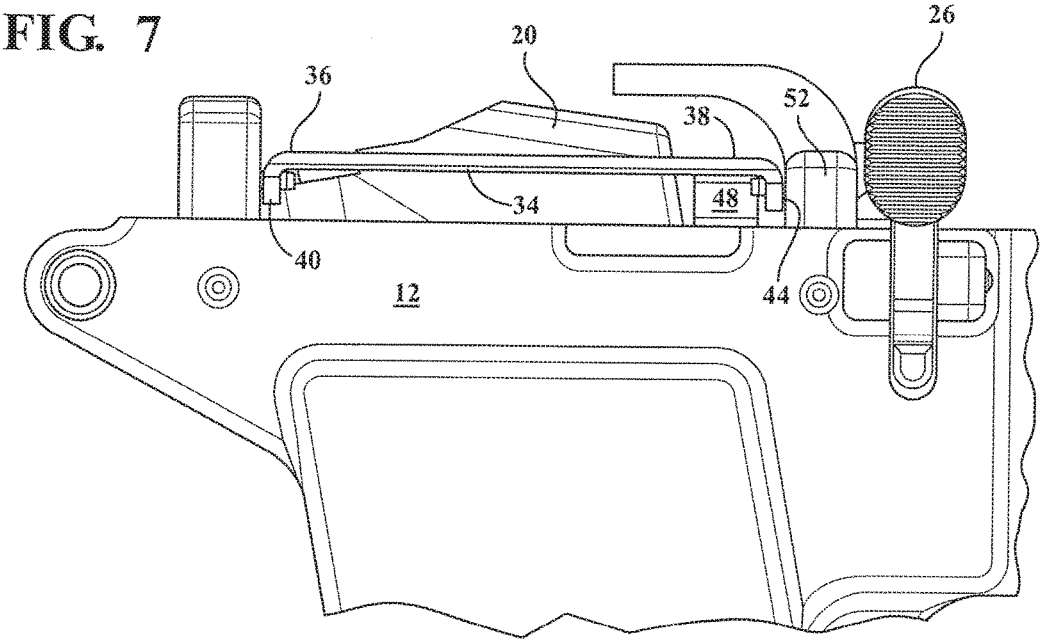
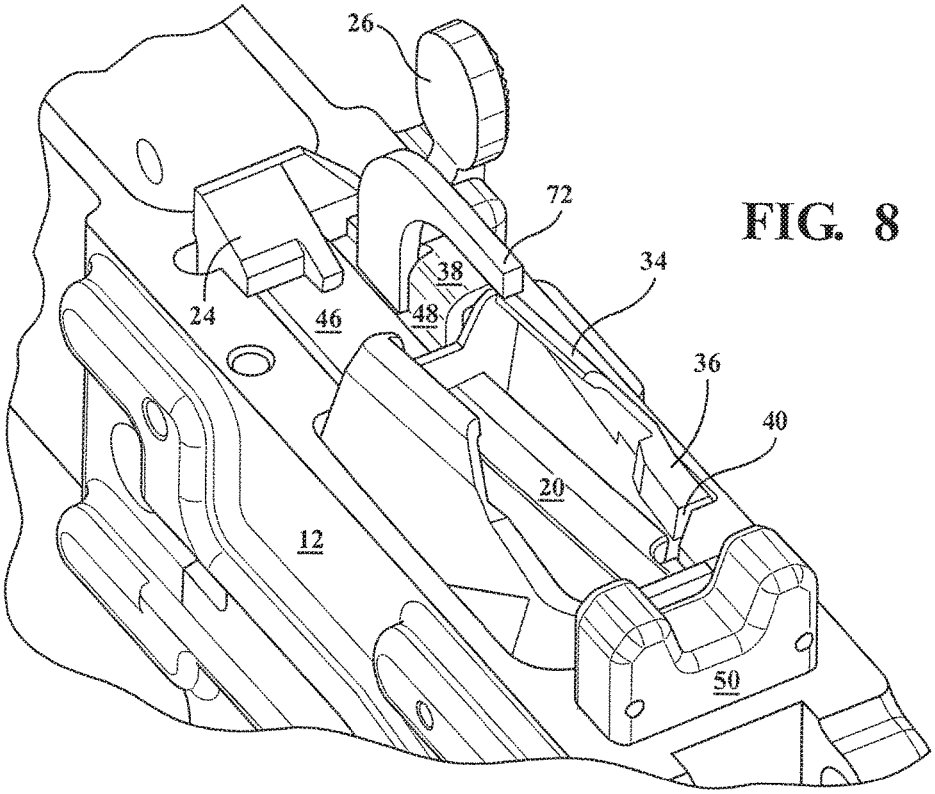
FIG. 8

FIG. 11
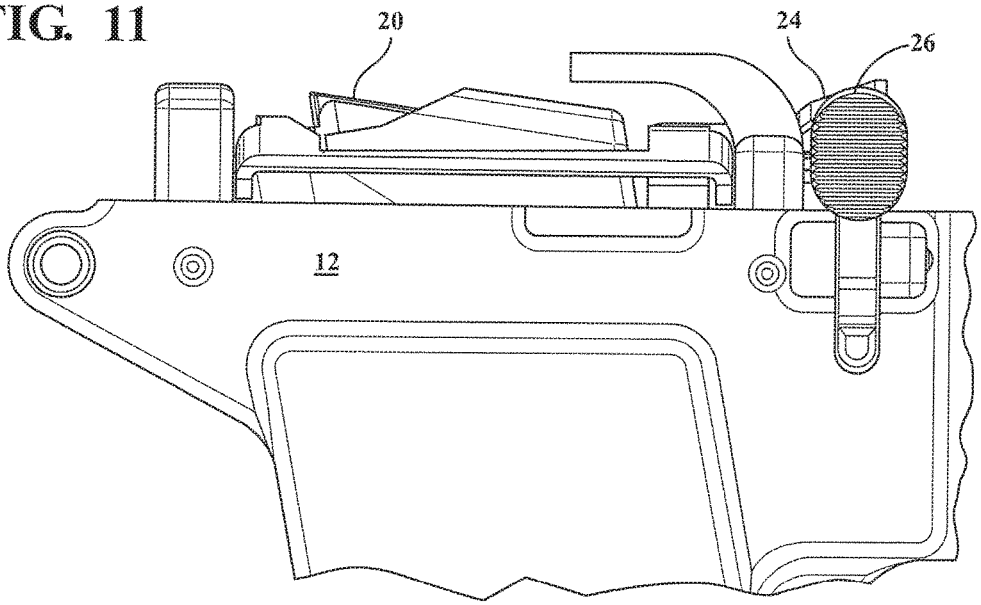
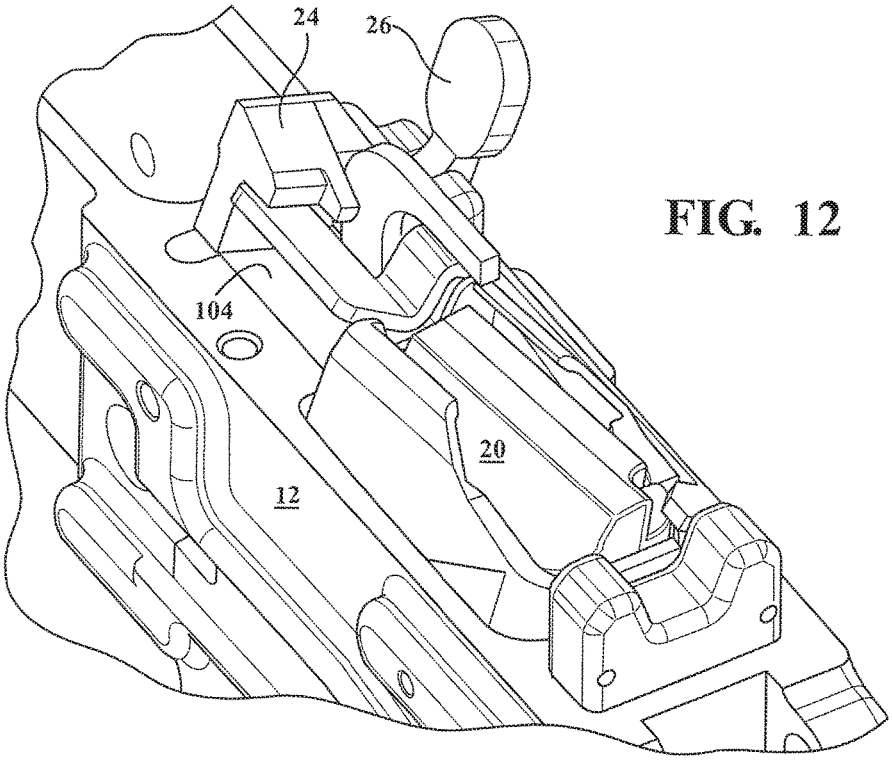
FIG. 12

ROTATIONALLY ACTUATED AND DUAL PIN SUPPORTED LINKAGE INCORPORATED INTO A LOWER RECEIVER OF A FIREARM FOR ESTABLISHING A LAST SHOT HOLD OPEN CONDITION WITH AN UPWARDLY DISPLACEABLE MAGAZINE FOLLOWER

CROSS REFERENCE TO RELATED APPLICATIONS

The present application claims the priority of U.S. Ser. No. 62/263,285 filed Dec. 4, 2015, the contents of which are incorporated herein in its entirety.

FIELD OF THE INVENTION

The present invention relates generally to a linkage for accomplishing a last shot bolt-hold open condition for a firearm. More specifically, the present invention discloses a pivotally dual pin supported and elongated linkage incorporated into a lower receiver of a firearm in communication with the open top of the magazine receiving well. A rotating shoulder of the linkage is configured to engage an underside of a vertically displaceable bolt catch associated with the lower receiver and, upon engagement of an upper receiver with a reciprocating bolt action assembly, the bolt is restrained in an open position following discharge of a final round from the magazine.

BACKGROUND OF THE INVENTION

The prior art is documented with examples of bolt hold open action assemblies in use with the upper and lower receivers of a firearm. The DDLES/Quarter Circle 10 last round hold open linkage, depicted in FIG. 1 of the present application, teaches a version of an elongated linkage which is supported at a single forward end location of the lower receiver and, upon the follower acting upon the linkage, it is caused to pivot about the front pin with the bolt catch being lifted at the rear free extending end. Reference is also made to the Angstadt Arms Disclosure for a lower receiver with bolt catch installation guide.

A further set of examples of last shot bolt hold open assemblies are disclosed in U.S. Pat. No. 8,479,635 and U.S. Pat. No. 9,091,499, both to Overstreet et al., and which each teach a bolt hold open catch assembly configured for operating with rim fire ammunition for use with a firearm including a receiver with an exposed receiving chamber. A drop in housing is supported upon the lower receiving chamber, with a catch supported in elevate-able fashion at an end of the supported housing.

A downwardly extending portion of the catch is configured to being manipulated by an externally configured and toggled bolt catch for raising the housing supported catch into contact with the forwardly traveling bolt, such as following release of a previously retracted charging handle. The catch can alternatively be actuated upwardly by a suitably configured follower associated with an attachable and cartridge holding magazine, this again following a last shot hold open protocol.

Overstreet, U.S. Pat. No. 8,387,296 teaches another version of a bolt catch assembly for use with a firearm including a receiver with an exposed receiving chamber and an underside engageable magazine. The assembly includes a bolt catch actuator housing supported in seating fashion relative to the receiving chamber and communicating with an attachable magazine. A catch actuator is supported in elevatable fashion relative to an end of the actuator housing. A follower component is upwardly and biasingly disposed within the magazine and which, upon contacting the catch actuator, displaces an associated bolt catch of the firearm in an upper and bolt restraining position.

Other examples of displacement or lift engaging bolt catch mechanisms include those taught by Atchisson, U.S. Pat. No. 4,128,042 and Sisgold, U.S. Pat. No. 8,572,875. Also noted is the repeating firearm with bolt-open latch taught by Seecamp, U.S. Pat. No. 3,688,640, and the last shot bolt hold-open device of Osborne, U.S. Pat. No. 4,455,919.

SUMMARY OF THE INVENTION

The present invention is an elongated bolt hold open linkage which is an improvement over prior art designs. The present design provides two position (fore and aft axially aligning pin located) pivotally elevating support to the linkage in extending fashion overhead the magazine well of the lower receiver.

A pair of fore and aft bridge supports are secured atop the lower receiver, over which is engaged the upper receiver with interior reciprocating bolt action components. Upon being contacted by an upwardly displacing magazine follower, subsequent to discharge of a remaining cartridge supported within the lower receiver attached magazine, the linkage is caused to rotate about its fore/aft axially aligning pivot pin locations. The linkage includes a flattened shoulder component which, upon upward and rotating actuation, acts upon an underside ledge of the lower receiver mounted bolt catch in order to upwardly deflect the same into a last shot hold open position for intercepting the forwardly displacing bolt associated with the upper action assembly.

BRIEF DESCRIPTION OF THE DRAWINGS

Reference will now be made to the attached drawings, when read in combination with the following detailed description, wherein like reference numerals refer to like parts throughout the several views, and in which:

FIG. 7 is a rotated side plan view of the BHOA linkage in the position of FIG. 6;

FIG. 8 is a rotated perspective similar to FIG. 6 of the BHOA linkage;

FIG. 11 is a rotated side line art view of the linkage in FIG. 10;

FIG. 12 is a rotated perspective illustration of the BHOA linkage shown in FIG. 10 with the follower upwardly displacing the linkage into elevating contact with the bolt catch;

DETAILED DESCRIPTION OF THE PREFERRED EMBODIMENTS

With subsequent reference to the below described illustrations of the variants of FIGS. 2-13 and 14-22, the present invention provides a last shot bolt hold open catch linkage which is integrated into a firearm lower receiver in order to assist in lifting a conventional bolt catch into upward and blocking engagement with a forwardly displacing bolt, this in order to obstruct the same in order to maintain the firing chamber in an open position. As will be further described, the present invention teaches a bolt catch accessory installed between upper and lower receiver assemblies associated with any suitable firearm but in one applicable variant to any of a related family of M-16 or AR-15 firearms.

Figure 1:
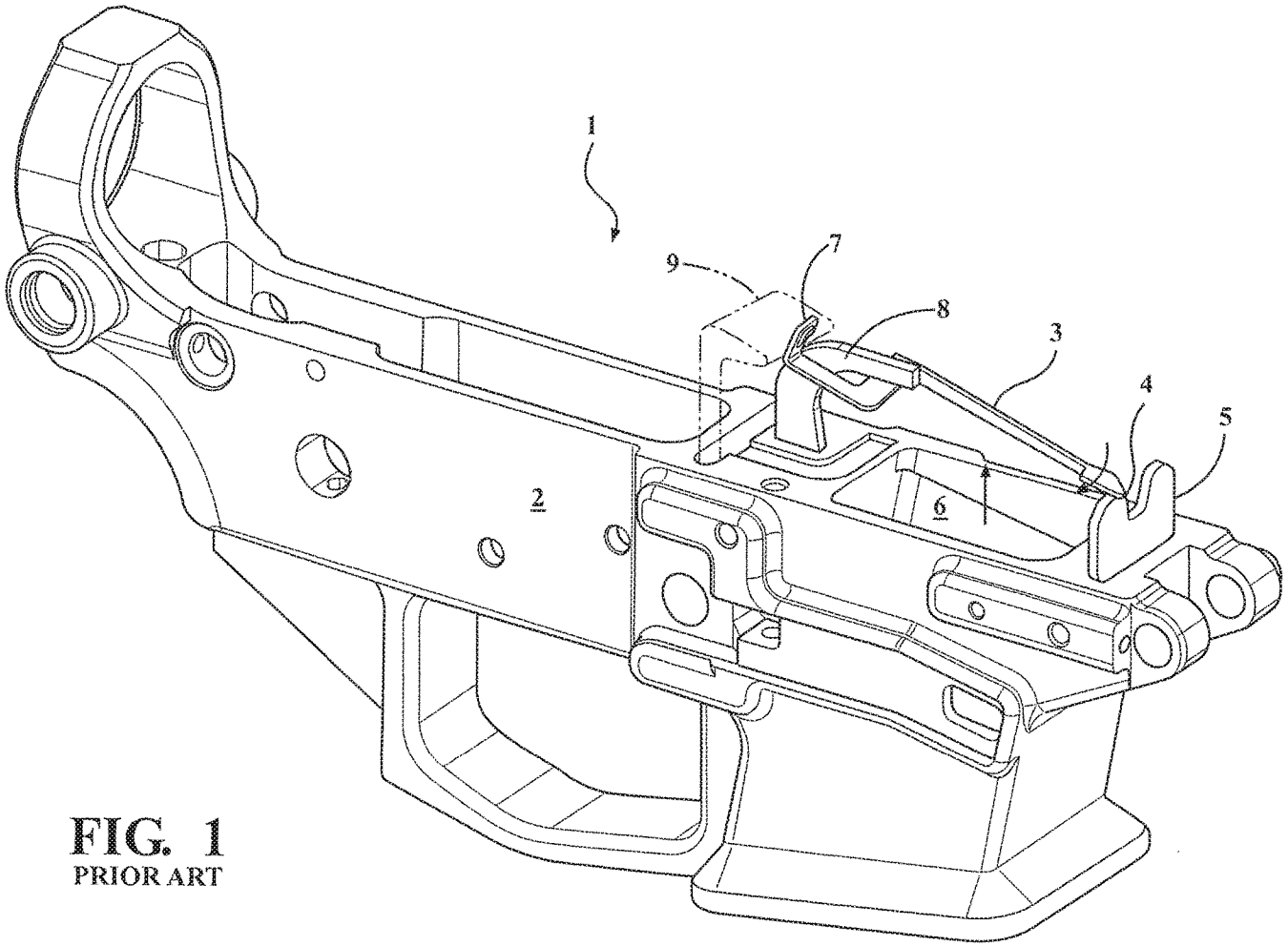
FIG. 1 PRIOR ART
FIGS. 1 and 1A are a pair of Prior Art illustration of a last nd hold open linkage in which the linkage is supported at a single end location of the lower receiver and, upon the follower acting upon the linkage, it is caused to pivot in a non-axial fashion about the front pin with the bolt catch being lifted at the rear free extending end.

Referencing initially to FIG. 1, an illustration made at 1 of single pinned bolt catch mechanism as known in the prior art (DDLES Glock Large Frame Lower Receiver, notably page 11). This includes a depiction of a firearm (in this instance an AR-15 type firearm) lower receiver 2 with a linkage 3 connected at a forward end 4 in a pivoting fashion to a pedestal 5 arranged forwardly of an open magazine well 6.

A rear and free extending end 7 of the linkage is configured to extend around and beyond an upwardly configured ejector 8 mounted to the lower receiver in engagement with an underside lip edge of an upwardly actuate-able bolt catch 9. The magazine follower (not shown) upwardly displaces following discharge of a final magazine round, with resultant contact with the linkage causing the same to rotate about the forward pinned edge and to lift the bolt catch 9 at the free rear end in order to intercept the forwardly displacing bolt (not shown).

Figure 1A:
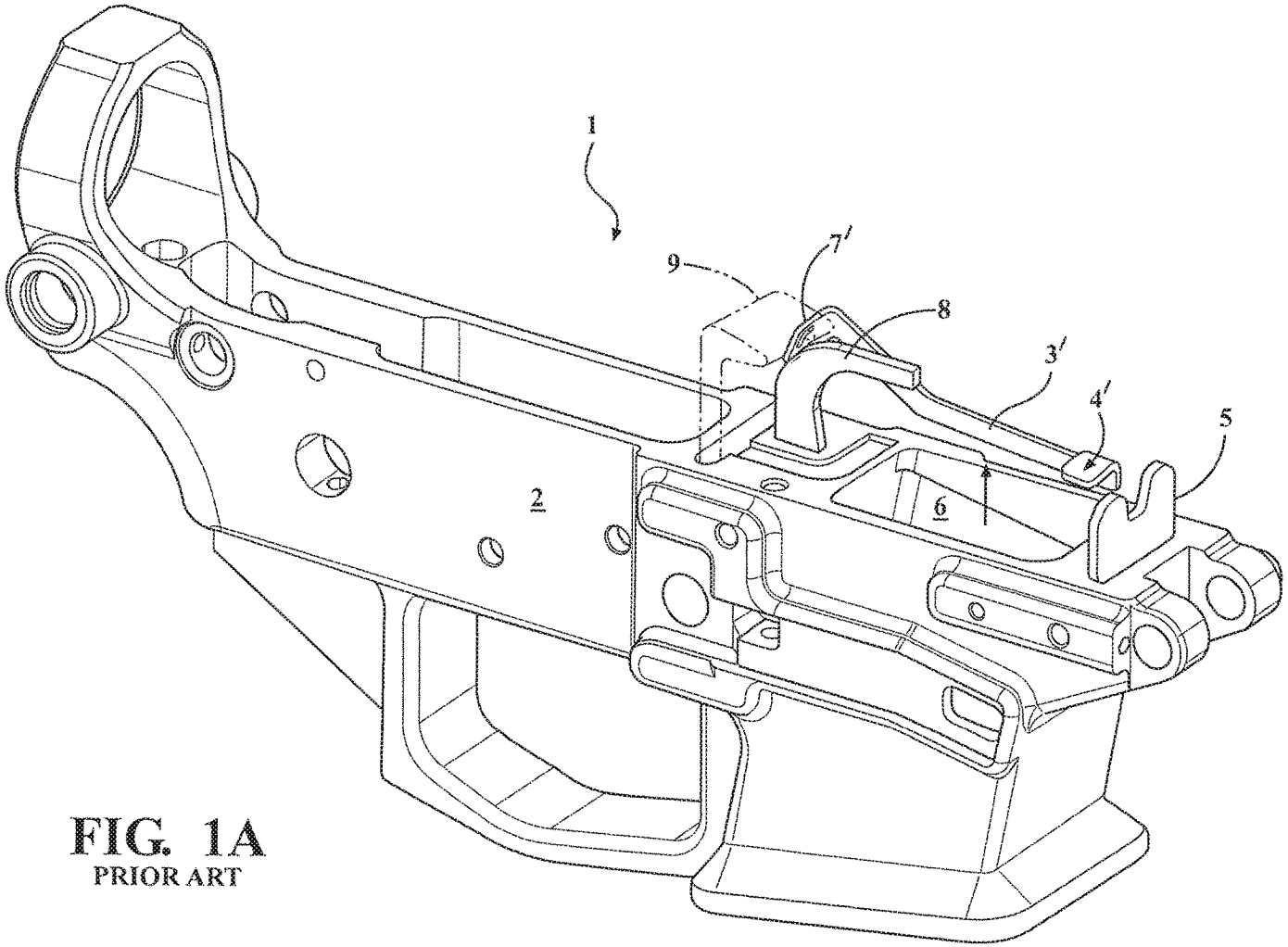
FIG. 1A PRIOR ART

A similar single pinned last shot bolt hold open mechanism (BHOA) is also depicted on page 3 of the Angstadt Arms lower receiver which, similar to FIG. 1, also is pinned at only a single end so that magazine follower induced rotation causes a rear configured and free extending end of the linkage to contact and upwardly lift the bolt catch. FIG. 1A is a related illustration to FIG. 1, also according to the Prior Art, and which depicts a related and single end pinned/rotationally supported reconfiguration of a linkage 3', again with a forward end 4' and rear extending end 7', and to facilitate elevation of the bolt catch 9. Given this quick illustration, reference will now be had to FIG. 2 et seq., which disclose the last shot bolt hold open (BHOA) mechanism of the present invention will now be described which provides dual (fore and aft) pinned support.

Figure 4:
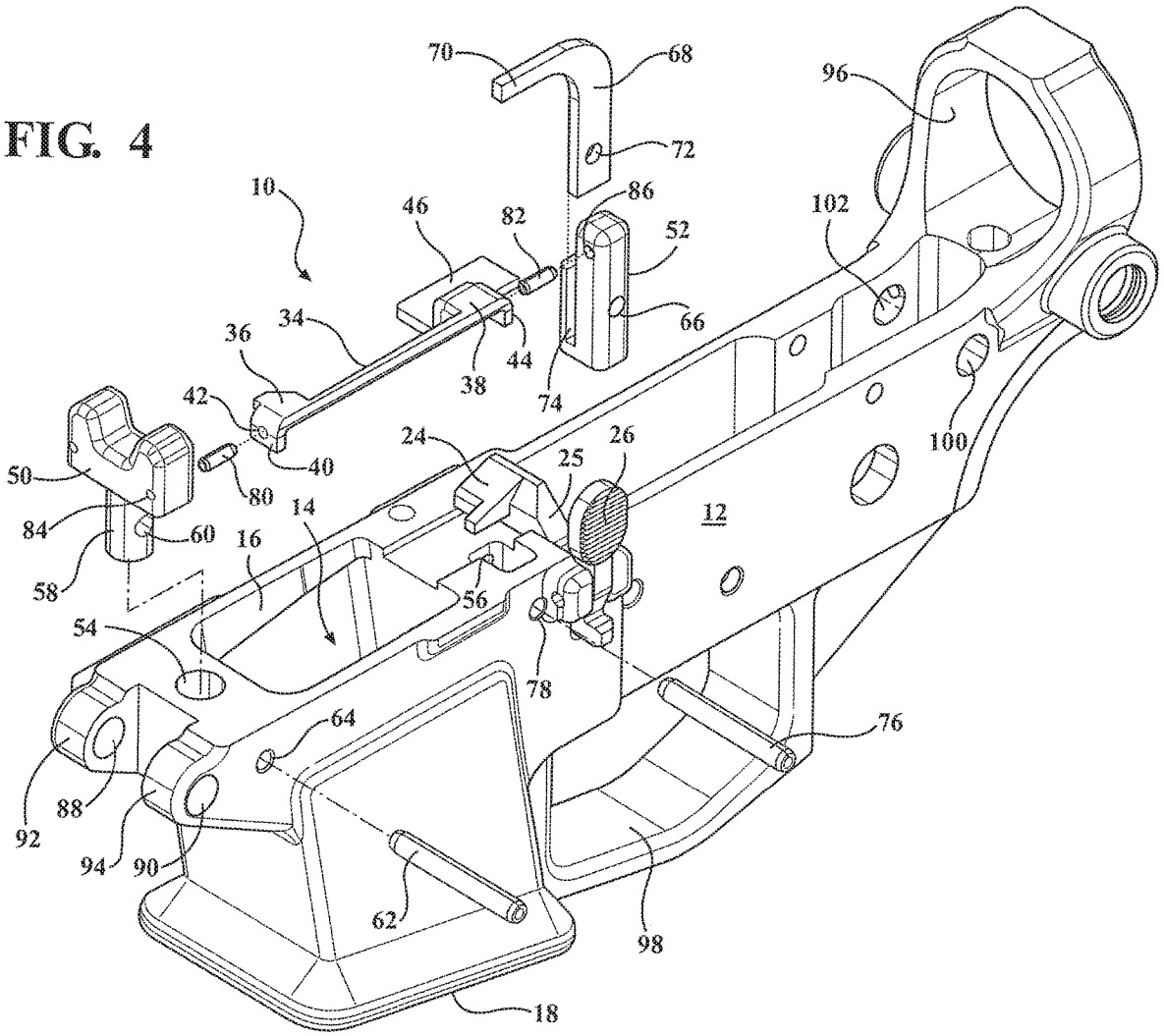
FIG. 4 is an exploded view of the lower receiver with upper mounted BHOA linkage and better illustrating the features of a forward bridge supports secured to the lower receiver in proximity to the forward most pivot pin location, combined with a rearward bridge support secured to a rearwardly displaced location of the lower receiver on an opposite side of the magazine well, the bridge supports establishing pivot pin support to opposite ends of the elongated BHOA linkage, the rearward bridge support further anchoring an elevated abutment ledge for defining a maximum pivoting elevation of the linkage concurrent with contacting and elevating the bolt catch.
Figure 5:
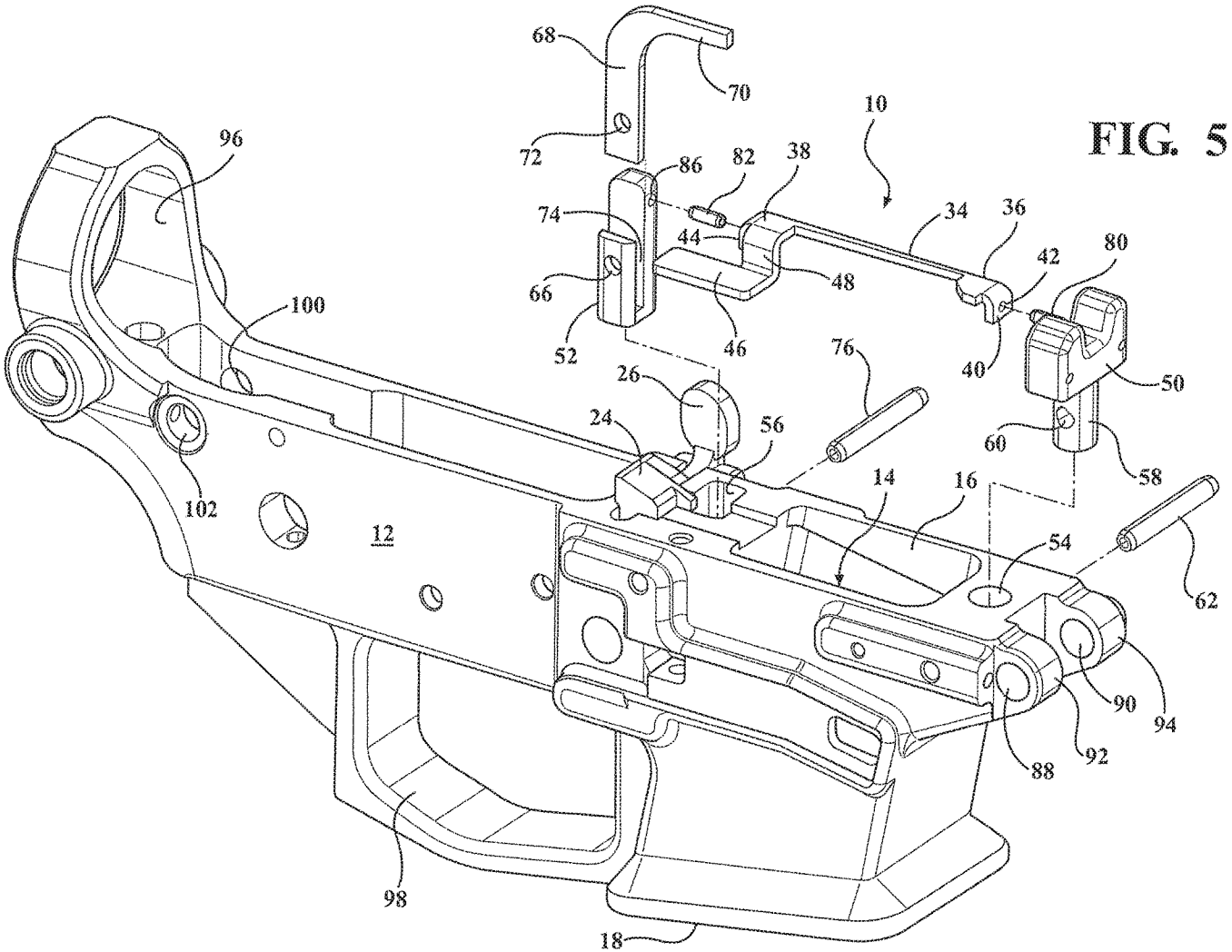
FIG. 5 is a rotated perspective of the lower receiver and BHOA linkage and further showing from another angle the pair of crosswise mounting pins for securing the forward and rearward bridge supports.

Given the above, the present in particular discloses a bolt catch linkage, see as generally depicted at 10 in each of FIGS. 4-5, supported atop an upper exposed rim of a lower receiver defined open well for receiving a cartridge supporting magazine. As will be described in additional detail, the linkage is pivotally supported at both fore and aft positions so that it extends over the open well and, upon being pivotally acted upon by the upwardly displacing magazine follower (following discharge of the final cartridge from magazine) a flattened shoulder portion of the linkage is caused to engage an underside ledge of a conventional bolt catch for causing the same to upwardly displace in order to intercept the forward traveling bolt of the reciprocating action assembly (not shown).

As further shown throughout the appended illustrations, a lower receiver 12 is provided for such as an M-16/AR-15 type firearm. A corresponding upper receiver containing the inner reciprocating action assembly is not shown, but is understood to correspond to such upper receivers as are conventionally known and which include an upper receiver frame with forwardly mounted barrel and outer hand guard and inner reciprocating supported bolt action assembly.

For purposes of the present description, the lower receiver 12 best depicted in shell form in FIGS. 4-5 according to one non-limited embodiment, can be partially modified for integrating the BHOA linkage and includes a forward end with a magazine attachment well defined by an inner well 14 (see as best generally depicted in FIG. 4) extending between a top rim 16 and underside/bottom rim 18 of the lower receiver. As is further shown, a magazine follower 20 associated with a magazine 22 (as conventionally understood being spring loaded within the magazine in upwardly displacing fashion in order to maintain an upward bias to each remaining cartridge loaded into the magazine) is attached to the lower receiver 12 through the underside rim 18 and so that, as best shown in FIGS. 8 and 12, upward displacement of the follower 20 following discharge of a final round or cartridge results in pivoting elevation/displacement of the receiver mounted bolt catch, further depicted at 24.

Figure 2:
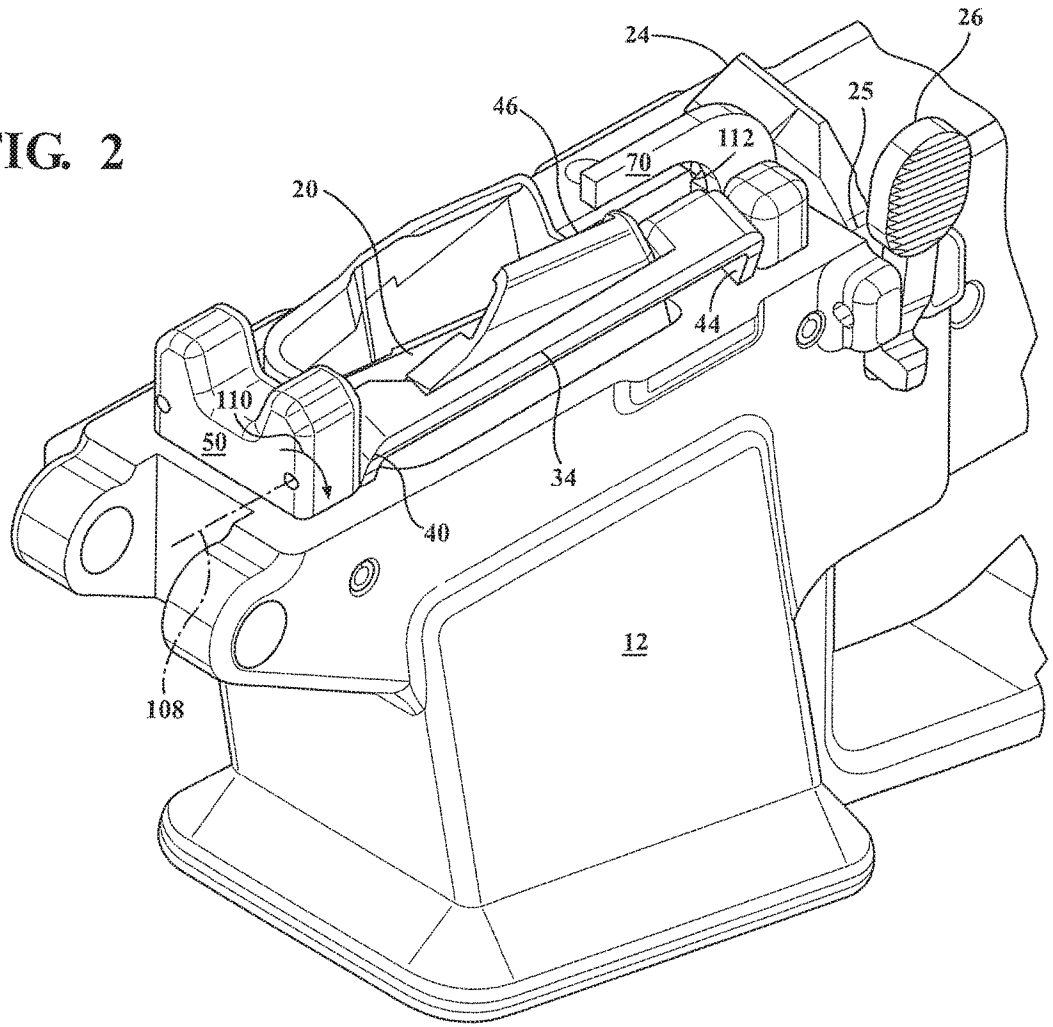
FIG. 2 is a perspective of a disassembled lower receiver with pivotally supported and elongated hold open linkage according to one non-limiting embodiment of the present invention.
Figure 3:
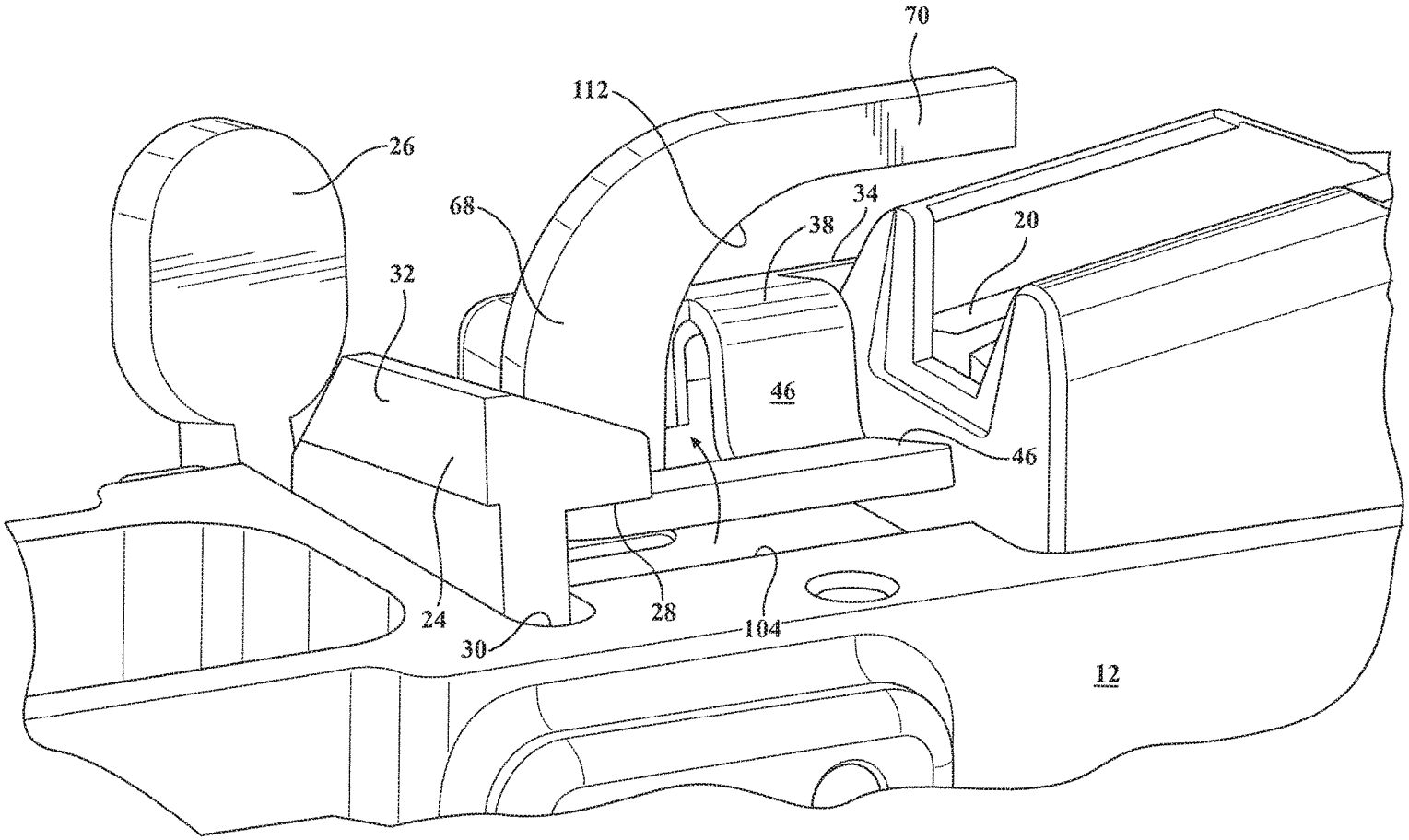
FIG. 3 is a rotated and enlarged second perspective of the elongated linkage of FIG. 2 and better illustrating a back side extending and flattened shoulder which, upon rotationally induced displacement of the linkage by the upwardly displacing magazine follower, is upwardly pivoted into engagement with the conventional bolt catch in order to elevate the same into the last shot bolt hold open condition with the forwardly displacing bolt.

As further shown, the bolt catch is typically installed into the receiver and illustrated by a user engageable (thumb actuated) portion 26. Referring in particular to FIGS. 2-3 in combination, the conventional bolt catch 24 includes a sloped upper body exhibiting a ledge underside 28 (for being acted upon by the BHOA linkage as will be further described). The catch portion 24 is connected by an angled intermediate portion (see as best shown at 25 in FIGS. 2 and 6) to the exterior mounted thumb actuated portion 26. The bolt catch seats within a recess profile (at 30 in FIG. 3) defined in the upper surface of the receiver 12, the configuration of which facilitates the upwardly/angled motion of the catch 24 as depicted and so that its rearward flush surface, at 32, provides an abutment stop to the forwardly traveling bolt (not shown).

As is known, the bolt is a mechanical part of the firearm which blocks a rear of the associated chamber during burning of the propellant. In semi-automatic firearms, such as is the case AR-15 type firearms, the bolt is caused to cycle back and forth during each cartridge discharge cycle, propelled by recoil/expanding gas (backwards) or spring recoil (forwards). Upon moving back, an elongated lug disposed upon a bottom of the reciprocating bolt strips the cartridge casing (also not shown) from the magazine 22 and pushes it into the firearm chamber.

Upon discharge, and once the spent shell casing case is clear of the chamber, an ejector component (further depicted and described below at 70) is typically integrated into the lower receives (in certain applications it may also include an integral component of the bolt along with the firing pin), for ejecting the casing from the receiver and out of the firearm. As is also known, depressing of the bolt catch 24 from its upwardly pivoted position releases the bolt to travel to a forward closed position.

Referring again to the exposed perspectives of FIGS. 2-3 (upper receiver removed) in combination with the rotated perspectives of FIGS. 4-5, the BHOA linkage 10 is constructed of a grade steel or other suitable material and includes an elongated central stem 34 having a forward enlarged end 36 and an opposite rearward end 38. The forward end 36 further includes a downwardly angled portion 40 with a pin receiving aperture 42 (see FIG. 4), with the rearward end 38 likewise including a downwardly angled portion 44, through which is formed a further pin receiving aperture (not) shown in axial alignment with the pin aperture 42 at the forward end. A flattened (plate shaped) shoulder 46 is supported, via a downwardly extending portion 48, from the rearward end 38 and defines the contacting ledge for upwardly engaging the underside of the bolt catch ledge 28.

A pair of forward 50 and rearward 52 spaced apart bridge supports are provided (see as best shown in FIG. 4) and which are mounted to receiving aperture locations 54 and 56 associated with the upper surface of the lower receiver 12 on opposite ends of the magazine well 14. The forward bridge support 50 exhibits a steno 58 with a crosswise extending receiving aperture 60 and which, upon inserting into the receiving aperture location 54, receives a first mounting pin 62 inserted crosswise through an aperture 64 (FIG. 4) in the lower receiver 14.

The rearward bridge support 52 likewise exhibits a main body with a crosswise aperture 66. The ejector component again includes an upwardly extending abutment member with a vertical extending portion 68 and an angled upper portion 70 which establishes the above-described ejector for ejecting the casing from the firearm. An aperture 72 is configured into the extending portion 68 (again FIG. 4) and, upon inserting the abutment member into a vertical slot 74 defined in the rearward bridge support 52, a second mounting pin 76 is inserted crosswise through an aperture 78 (again FIG. 4) in the lower receiver.

Referring still to FIG. 4, a further pair of axial pins 80 and 82 are provided and which are anchored to opposite axial defined apertures 84 and 86 defined in the forward 50 and rearward 52 bridge supports, the pins 80 and 82 also seating at opposite ends through the aperture 42 in the forward downwardly angled portion 40 as well as the other hidden aperture in the rearward downwardly angled portion 44 in order to pivotally mount the linkage in extending fashion between the bridge supports and overhead the upper rim 16 of the magazine well 14. It is further understood that the configuration of the bridge supports and associated architecture of the lower receiver 12 is such that it seamlessly receives the installation of the upper receiver (not shown) with its associated reciprocating action assembly.

The lower receiver 12 also includes a pair of receiving apertures 88 and 90 defined in forward most located mounting ears 92 and 94 for receiving the pivot pin (not shown) for securing the upper receiver once the same is installed from a forward end so that its rear seats within a circular reception portion 96 defined at a rearward most end of the lower receiver 12. Other and additional features associated with the lower receiver 12, not further commented upon, include a trigger 98 (the actual trigger assembly not being shown). An additional pair of apertures 100/102 are configured in opposite sides of the lower receiver 12 in proximity to the rear reception portion 96 for receiving a further takedown pin (not shown) in order to mount a further rear location of the upper receiver (such as including a further crosswise aperture receiving location which aligns with the apertures 100/102 upon slidably positioning the upper receiver into installed position with the lower receiver).

FIGS. 6-9 illustrate a first collection of perspective and plan view illustrations of the BHOA linkage 10 in a first recessed position atop the lower receiver 12 and by which the planar or plate shaped shoulder 46 is positioned within a recessed surface area (see depression 104 as best shown in FIG. 3) and so that an upper edge surface of the shoulder is positioned underneath the underside ledge 28 of the lower receiver bolt catch 24 (see also again FIG. 3). Upon discharge of a final cartridge from the magazine 22, the inner spring supported follower 20 is caused to upwardly displace (FIG. 9) so that an upper abutment face 106 is caused to elevate into contact with an underside of the forward end portion 36 of the linkage.

The contact location between the follower 20 upper edge and the forward end 36 of the BHOA linkage is further such that continued upward motion of the spring biased follower 20 results in the linkage being caused to pivot about an axial centerline 108 (see FIGS. 2 and 6) established between the forward and rearward pinned locations and such that the linkage is caused to pivot in the manner depicted by corresponding directional arrow 110. At this point, and referring to additional views FIGS. 10-13 as well as FIGS. 2-3, continued pivoting of the linkage by the follower 20 results in the bolt catch 24 being upwardly and angularly displaced by the plate shaped support 46 until such time as an inside edge location of the plate shape support 46 or corresponding connecting portion 48 is caused to abut an underside edge (at 112) of the abutment portion (68/70) and in order to define a most fully upwardly displaced position for the bolt catch 24 in which its rear surface 32 establishes an abutment stop for the forwardly displacing bolt (not shown) of the attached upper receiver Referring now to FIGS. 14-22, a second linkage variant of a last shot bolt hold open mechanism is depicted at 120 according to the present invention. For purposes of ease of explanation, duplicate e will be made to the elements repeated from the first embodiment, with description herein limited to the varying features of the updated linkage mechanism 120, it being further noted that the lower receiver 12' includes slight modifications from that depicted in FIG. 1.

The updated linkage 120 is integrated into a modified receiver 12' without a fixed ejector or a feed ramp. As such, the linkage 120 is pinned between a pair of simplified and generally cylindrical extending mounting posts 122 and 124, the forward post 122 mounting into forward aperture 54 (relative to the magazine well 14) and the rearward post 124 likewise mounting into a modification 56' of the rear aperture in the top surface of the lower receiver 12' proximate to the engaging underside ledge 28 of the elevatable bolt catch 24.

As shown, each of the posts 122 and 124 includes a lower width extending aperture, at 126 and 128, respectively, for receiving the inserted pins 62 and 76 in order to anchor the posts upon the receiver 12'. The posts 122/124 each further include an axial directed apertures or passageway, at 130 and 132, at an upper proximate end (see further opposing flattened faces 134/136). As further shown, the upper and lower apertures are angularly offset, such as including a ninety degree angle as depicted by axes 131 and 133 (FIG. 14) extending through selected apertures 126 and 130.

A further pair of pins 138 and 140 (compare at 80/82 in FIG. 4) are provided and anchor within the axially aligning and opposing apertures 130/132. The extending ends of the pins 138/140 are engaged by further apertures formed in the opposite axially aligning ends of the elongated linkage 120 (a forward of the apertures 142 shown in FIGS. 14-15 with a rearward aperture being hidden from view). Also depicted at 143 is an angled lip or edge location associated with the forward configured end 36' and which is engaged by the upwardly displacing magazine follower 20 in order to initiate rotation of the elongated linkage.

In comparison to the variant of FIG. 4, the linkage again includes an elongated central stem 34' having a forward enlarged end 36' and an opposite rearward end 38'. The forward end 36' further includes a front flattened end face 40' within which is defined the pin receiving aperture 142, with the rearward end 38' likewise including a downwardly angled portion 44' and a flattened shoulder 46' defining the contacting ledge for upwardly engaging the underside of the bolt catch ledge 28. A flattened rear end face (again hidden from view in FIGS. 14-15) is again provided for receiving the projecting pin 140 and, in combination with the flattened front face 40', provides for smooth pivoting/rotation of the linkage in axially aligned fashion between the front 122 and rear 124 posts.

Figure 6:
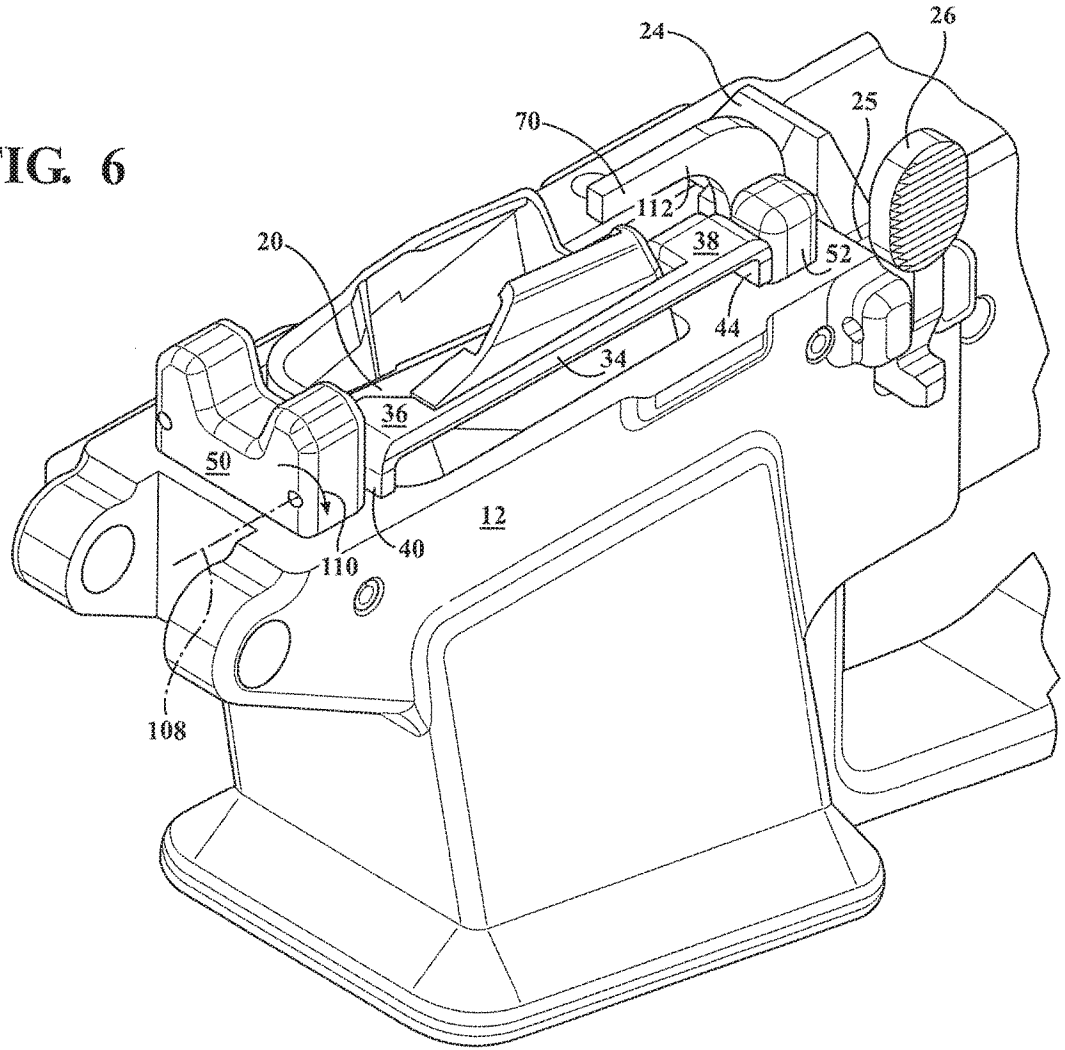
FIG. 6 is a perspective illustration of the BHOA linkage in an initially rotated and initial contacting position with the bolt catch, and in which the catch and external thumb actuated portions are initially actuated in an upwardly angled fashion.
Figure 9:
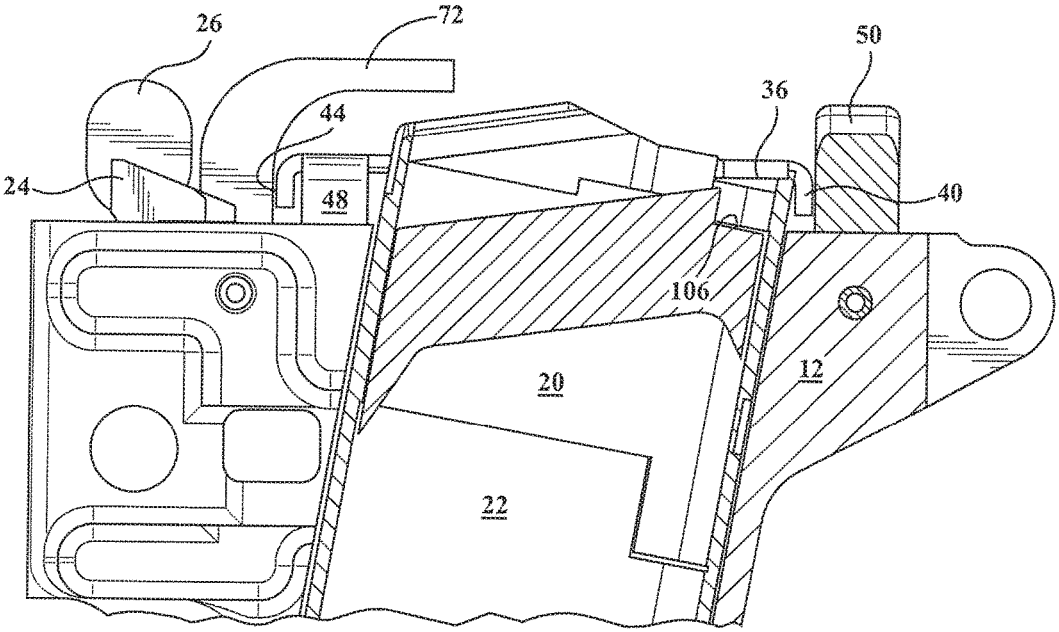
FIG. 9 is a reverse rotated plan view of the BHOA linkage and illustrating the upwardly displacing motion of the magazine follower for pivotally actuating the elongated and dual pin supported linkage into rotating contact with the bolt catch.
Figure 10:
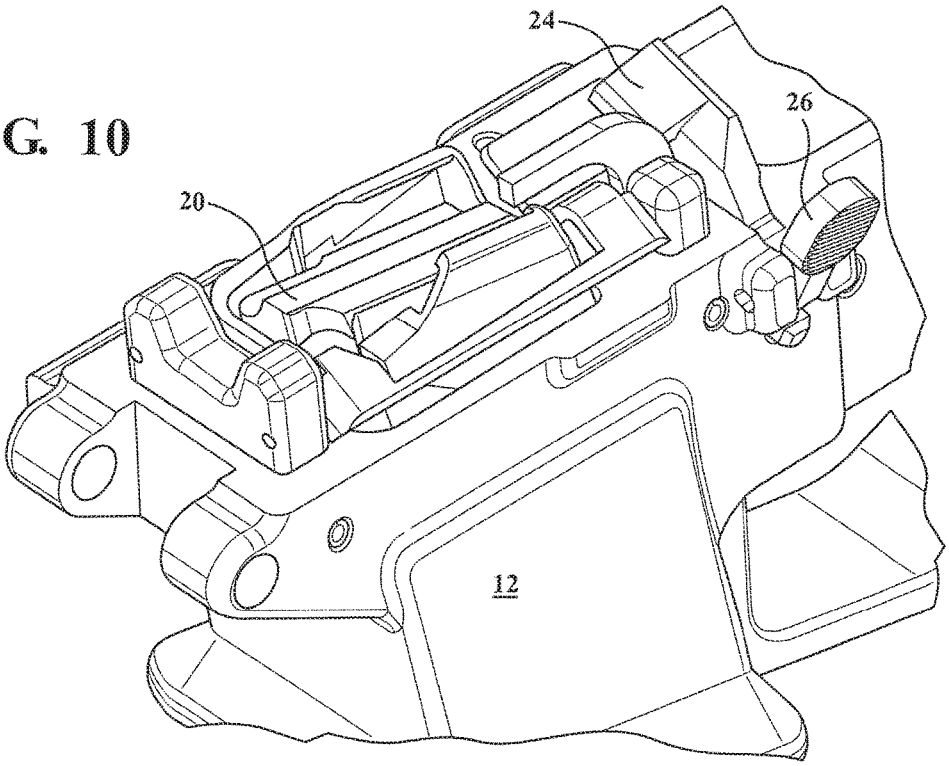
FIG. 10 is a perspective of the hold open (BHOA) linkage similar to FIG. 6 and depicting the magazine follower actuating the linkage to in turn upwardly displace the bolt catch into engagement with the forwardly traveling bolt.
Figure 13:
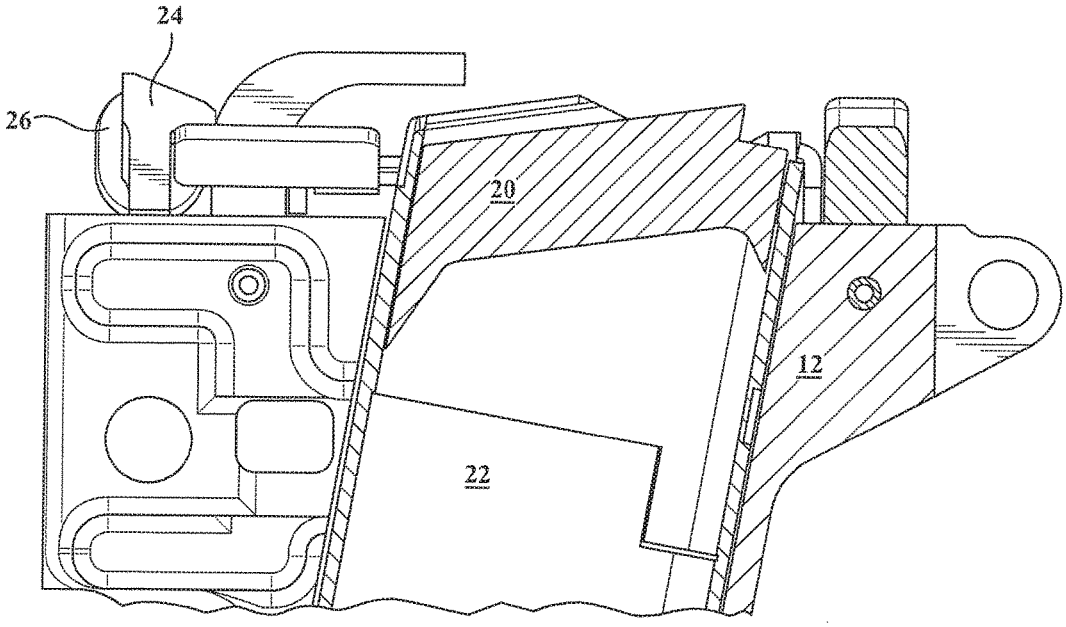
FIG. 13 is a rotated plan view to that shown FIG. 9 and which shows the contacting engagement of the follower with the linkage and pivoting/elevating shelf for actuating the bolt catch to a further upwardly displaced location.
Figure 14:
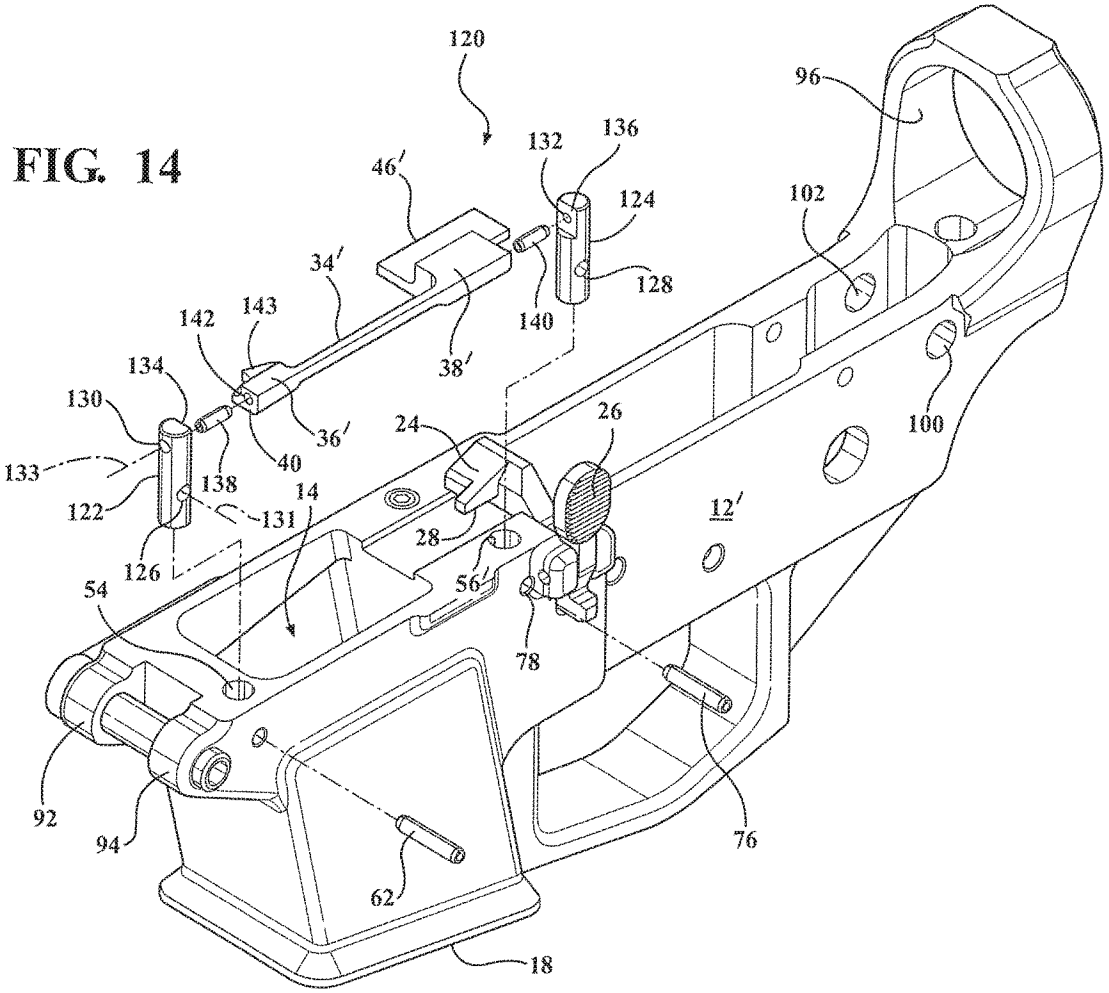
FIGS. 14 and 15 are a pair of exploded views similar to FIGS. 4 and 5 of a further variant of lower receiver with upper mounted BHOA linkage and illustrating first and second mounting posts for supporting the BHOA linkage in linear and dual pinned fashion.
Figure 15:
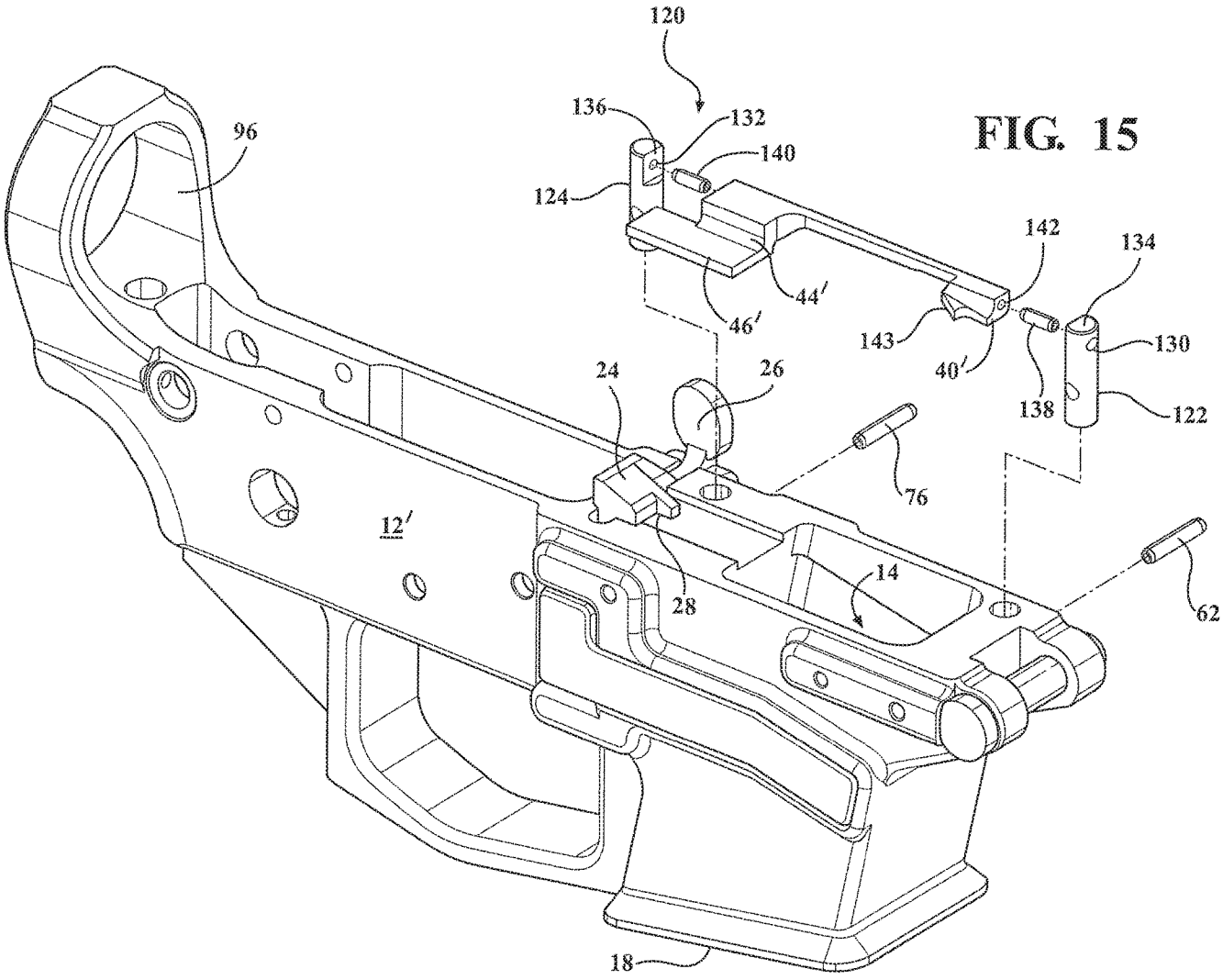
Figure 16:
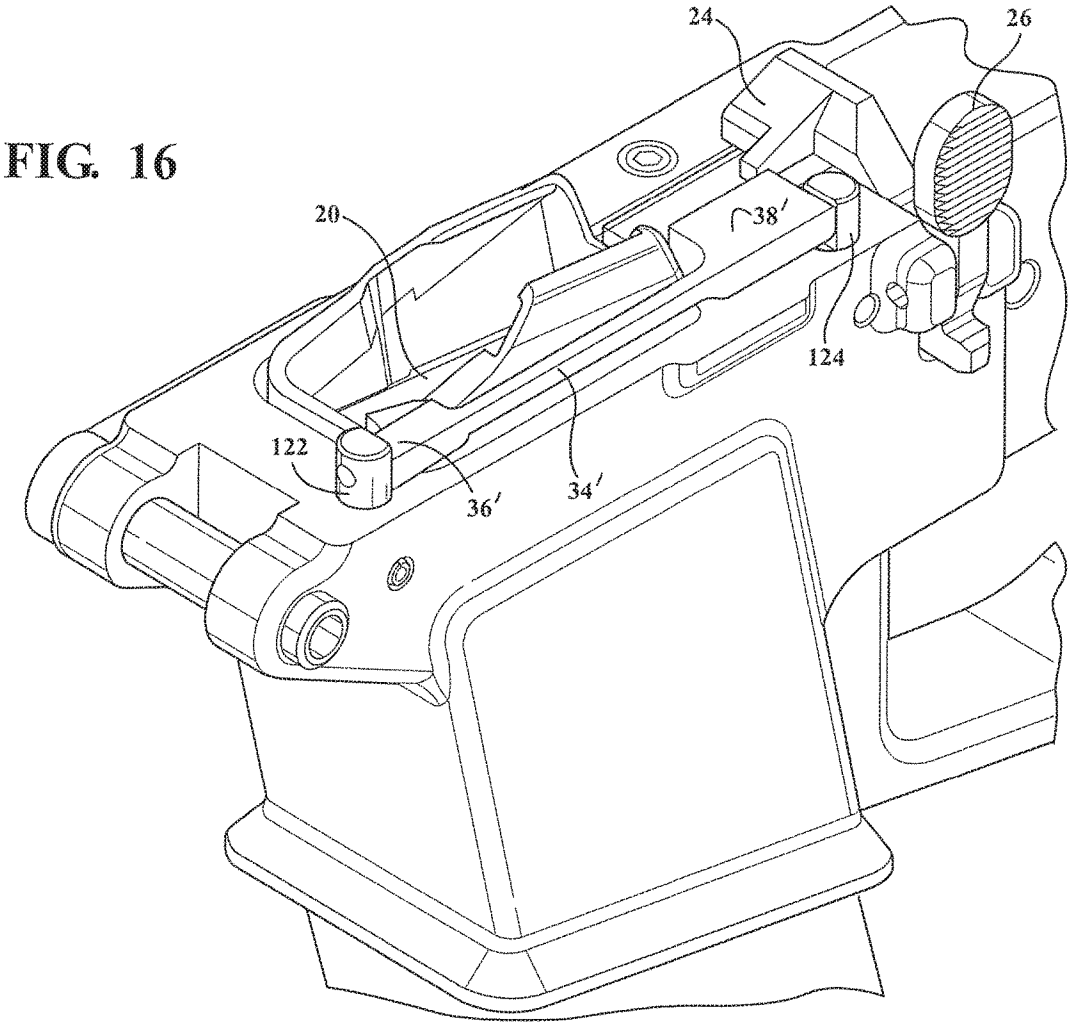
FIG. 16 is an illustration similar to that previously shown in FIG. 6 and illustrating a perspective illustration of the BHOA linkage in an initially rotated and initial contacting position with the bolt catch, and in which the catch and external thumb actuated portions are initially actuated in an upwardly angled fashion.

FIG. 16 is an illustration similar to that previously shown in FIG. 6 and illustrating a perspective illustration of the BHOA linkage in an initially rotated and initial contacting position with the bolt catch 24, and in which the catch and external thumb actuated portions are initially actuated in an upwardly angled fashion. The magazine follower is again indicated at 20 in a pre-actuating configuration relative to the bolt catch.

Figure 17:
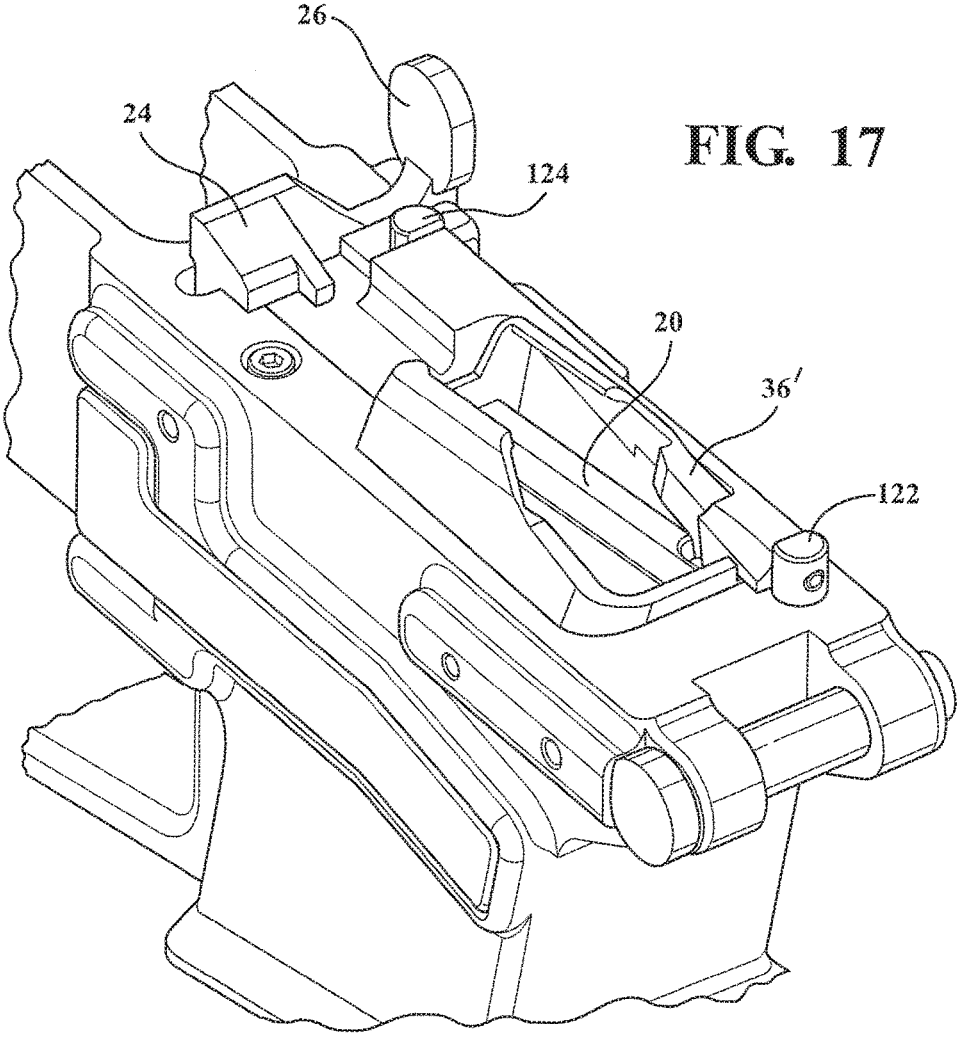
FIG. 17 is a rotated perspective of the BHOA linkage in FIG. 16.
Figure 18:
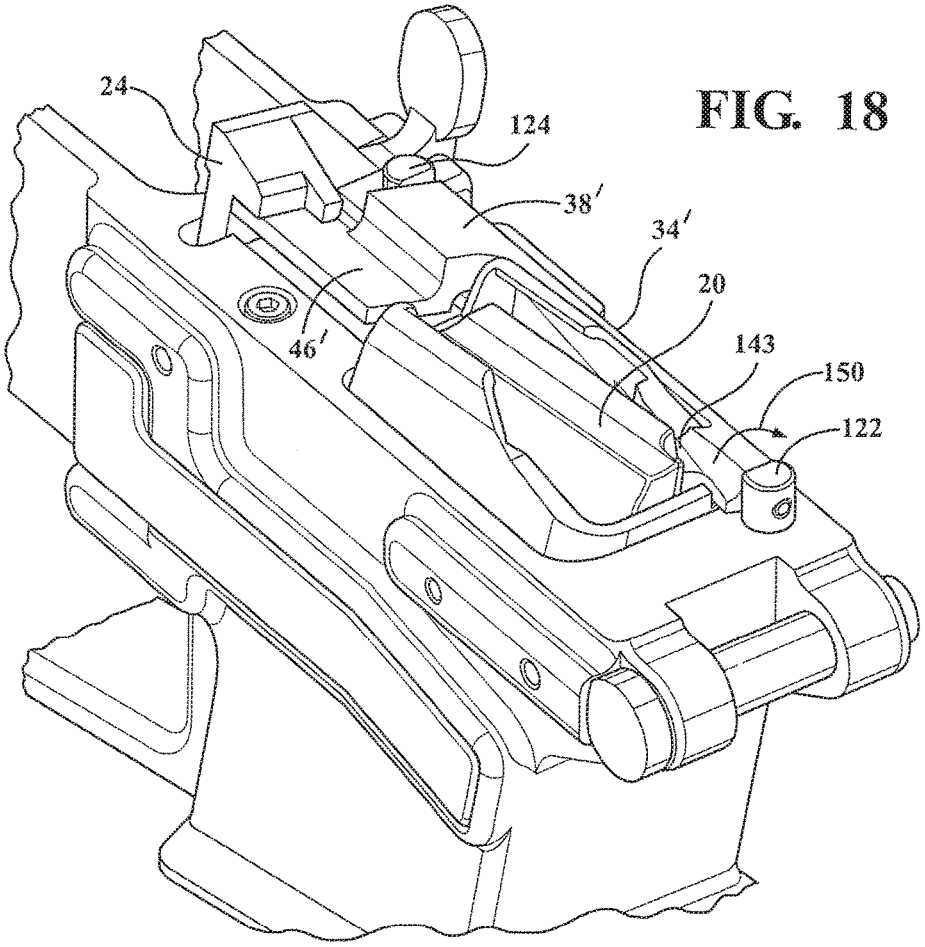
FIG. 18 is a succeeding illustration to FIG. 17 and showing the BHOA linkage actuated by the upwardly displacing magazine follower to in turn engage the bolt catch in an upwardly displaced position.

FIG. 17 is a rotated perspective of the BHOA linkage in FIG. 16 in pre-actuated position, with FIG. 18 providing a succeeding illustration to FIG. 17 and showing the magazine follower 20 upwardly displacing in order to rotate the BHOA linkage, via the forward engagement location 143. The linkage is then rotated a minimal range, about rotational arrow 150, with the rear planar portion 46' in turn lifting the bolt catch 24 to the an upwardly displaced position, again in which the forwardly traveling bolt (not shown) is intercepted following the recoil cycle attendant with the discharge of the final cartridge.

Figure 19:
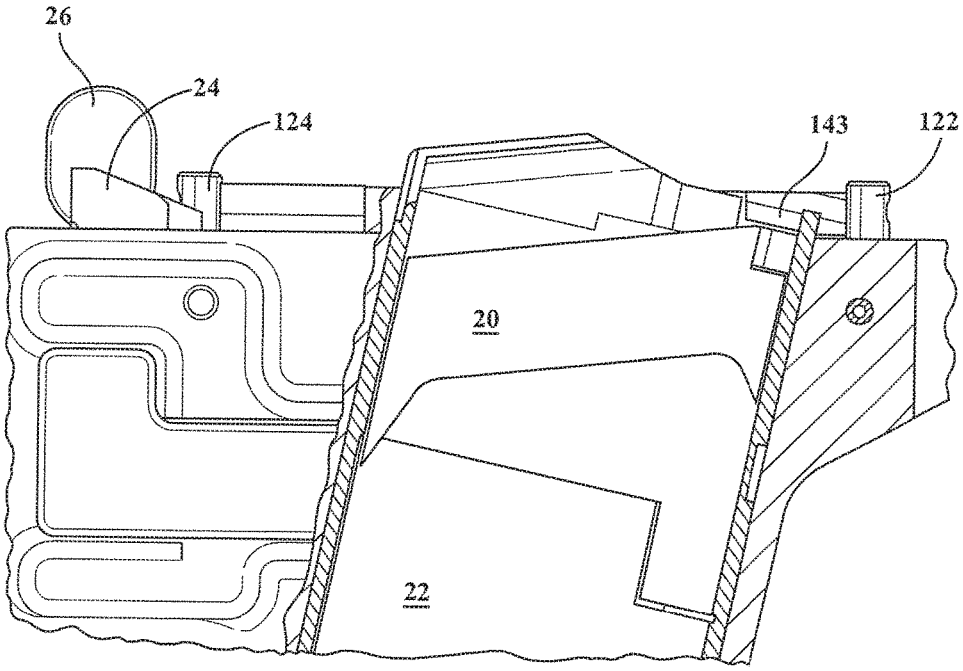
FIGS. 19-20 illustrate a pair of plan cutaway views of the magazine follower in both pre and post actuation of the bolt hold open linkage for elevating the bolt catch.
Figure 20:
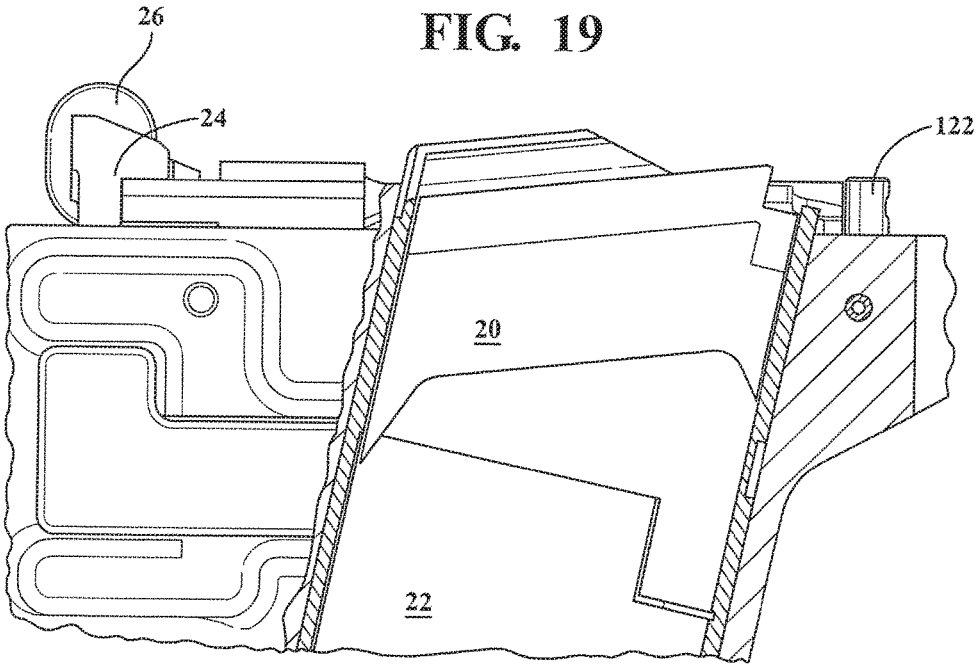
Figure 21:
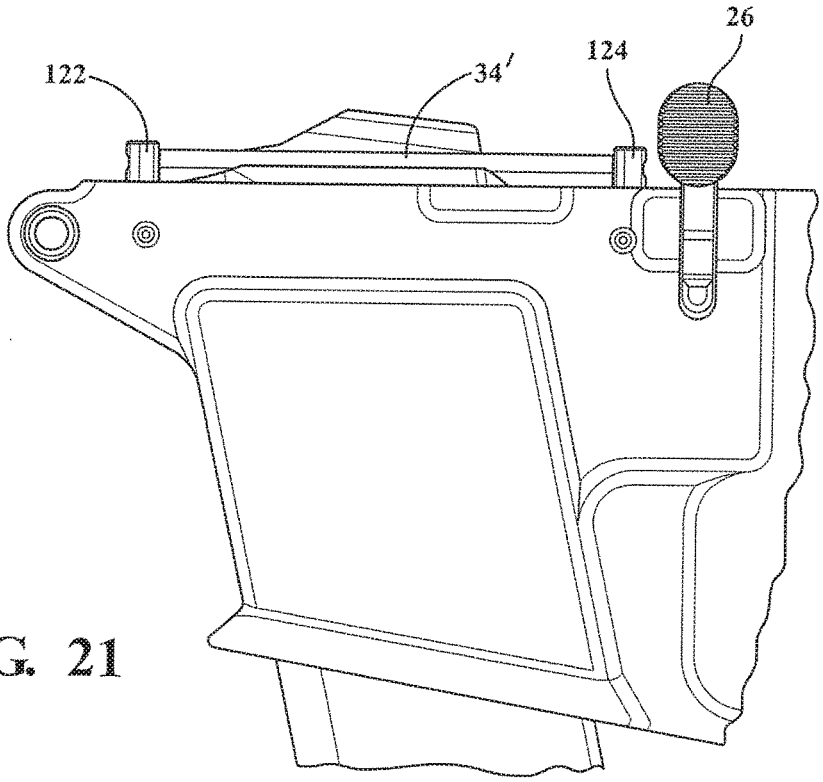
FIGS. 21-22 illustrate a pair of 180° rotated side sectional plan views relative to FIGS. 19-20 of the linkage in both pre and post actuated configurations for elevating the bolt catch.
Figure 22:
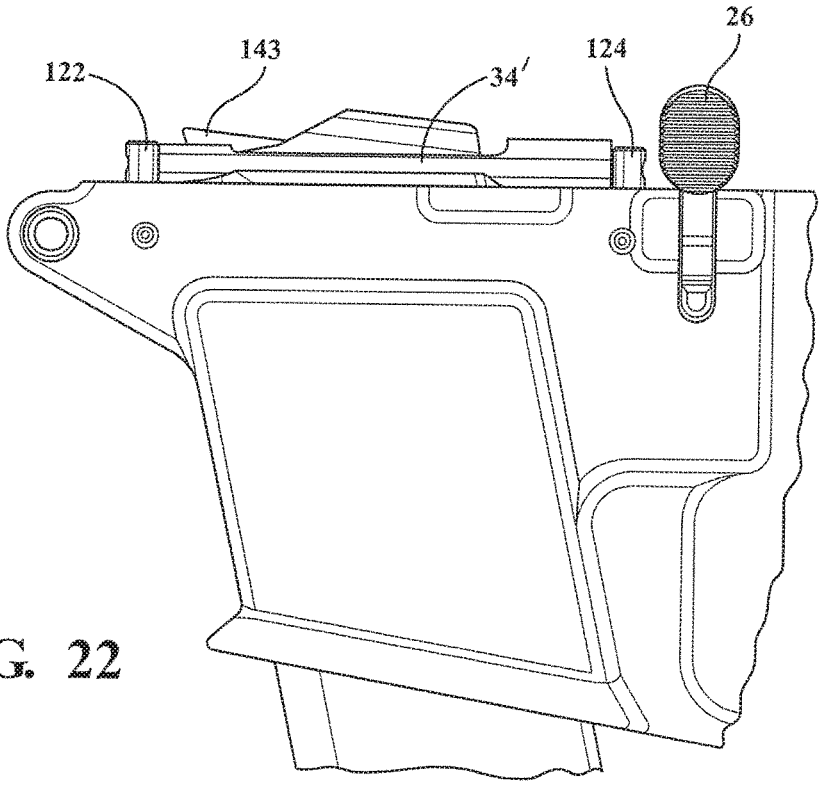

FIGS. 19-20 illustrate a pair of plan cutaway views of the magazine follower in both pre and post actuation of the bolt hold open linkage for elevating the bolt catch (see as positioned flush upon the upper receiver in FIG. 19 and elevated upwardly in the actuated view of FIG. 20). Finally FIGS. 21-22 illustrate a pair of 180° rotated side sectional plan views relative to FIGS. 19-20 of the linkage in both pre and post linkage rotating/bolt catch actuated configurations for elevating the bolt catch in engagement with the forwardly traveling bolt.

Beyond the variants shown, the linkage can exhibit other shapes and configurations utilizing a dual (fore and aft) pinned arrangement for translating upward displacement of the magazine follower (following last show discharge) to pivoting rotation of the linkage resulting in upward displacement of the bolt catch to the intercept position relative to the forwardly displacing bolt. The ability to pin the linkage at fore and aft locations further prevents bending or material stress/failure such as which may result from prior art linkages which are pinned at only one location. Additionally, and while a preferred embodiment contemplates the fore an aft pin mount locations of the linkage being axially aligned, the present inventions also envision the fore and aft pin mounts potentially being offset or angled consistent with the desired configuration of the linkage in order to convert the elevating motion of the magazine follower to lifting motion exerted on the bolt catch.

Having described my invention, other and additional preferred embodiments will become apparent to those skilled in the art to which it pertains, and without deviating from the scope of the appended claims.

We claim:

1. A bolt hold open linkage incorporated into a lower receiver of a firearm for elevating a bolt catch into contact with a forwardly displacing bolt associated with an upper receiver reciprocating action assembly, said linkage comprising:

an elongated stem having a forward end and an opposite rearward end;

a pair of axially spaced mounting pins supported at spaced apart and elevated locations of the lower receiver and defining an axis extending over a magazine receiving well incorporated into the lower receiver, said pins mounting said stem at said forward and rearward ends in pivoting fashion; and upon an upwardly displaceable follower associated with a magazine which is secured to the well being adapted to elevate into contact with said linkage at a location offset from a pivot axis established between said pins, a flattened shoulder projecting from said stem actuating in a combined pivoting and elevating fashion and adapted to contact and elevate the bolt catch for intercepting the forwardly displacing bolt.

2. The linkage as described in claim 1, said forward end of said linkage further comprising a downwardly angled portion with a first pin receiving aperture, said rearward end likewise including a further downwardly angled portion through which is formed a further pin receiving aperture.

3. The linkage as described in claim 2, the lower receiver including a pair of forward and rearward spaced apart bridge supports associated with an upper surface of the lower receiver on opposite ends of the magazine well, said axially extending pins pivotally mounting said linkage in extending fashion between said bridge supports.

4. The linkage as described in claim 1, said flattened shoulder further comprising a flattened plate shape, a downwardly extending portion interconnecting said plate shape with said stem so that said plate shape is in abutting contact with an underside ledge of the bolt catch.

5. The linkage as described in claim 1, further comprising an abutment member adapted to being secured to the lower receiver, said abutment member having a vertical extending portion and an angled upper portion which is contacted by said flattened shoulder to define a maximum pivoting contact location with said linkage.

6. The linkage as described in claim 1, said stem further comprising a shoulder supported, via an extending portion, from said rearward end.

7. The linkage as described in claim 1, further comprising a pair of cylindrical mounting posts affixed to said lower receiver for engaging said pins.

8. The linkage as described in claim 7, further comprising opposing mounting faces of said posts exhibiting flattened profiles.

9. The linkage as described in claim 8, said forward and rearward ends of said stem further comprising flattened end faces opposing said post mounting faces.

10. A bolt hold open linkage incorporated into a lower receiver of a firearm for elevating a bolt catch into contact with a forwardly displacing bolt associated with an upper receiver reciprocating action assembly, said linkage comprising:

an elongated stem pivotally mounted at fore and aft locations by a pair of axially aligning mounting pins supported at spaced apart locations of the lower receiver in extending fashion above a magazine receiving well incorporated into the lower receiver; and upon a follower contained within a magazine adapted to being secured to the well displacing upwardly following discharge of a final remaining round, the follower adapting to contact a first location of stem which is offset from a pivot axis extending between said fore and aft locations, pivoting of said stem causing a second axial offset location of said stem to be adapted to contact an underside location of the bolt catch and to elevate the bolt catch to intercept the forwardly displacing bolt.

11. The linkage as described in claim 10, said first contact location of said stem further comprising a portion extending from said fore location.

12. The linkage as described in claim 10, said second location of said stem further comprising a flattened shoulder extending from said aft location.

13. The linkage as described in claim 10, further comprising first and second pins mounting said stem at said fore and aft locations.

14. The linkage as described in claim 13, further comprising a pair of cylindrical mounting posts affixed to said lower receiver for engaging said pins.

15. The linkage as described in claim 14, further comprising opposing mounting faces of said posts exhibiting flattened profiles.

16. The linkage as described in claim 15, said forward and rearward ends of said stem further comprising flattened end faces opposing said post mounting faces.

17. The linkage as described in claim 14, further comprising lower apertures formed in said mounting posts which, upon aligning with apertures formed in the lower receiver, receiving laterally inserted pins for anchoring said posts.

18. The linkage as described in claim 17, further comprising upper apertures extending at an angle relative to said lower apertures, said upper apertures adapted to receiving said pins.

19. A bolt hold open linkage incorporated into a lower receiver of a firearm for elevating a bolt catch into contact with a forwardly displacing bolt associated with an upper receiver reciprocating action assembly, said linkage comprising:

an elongated stem having a forward end and an opposite rearward end;

a pair of axially spaced mounting pins supported at spaced apart and elevated locations of the lower receiver and defining an axis extending over a magazine receiving well incorporated into the lower receiver, said pins mounting said stem at said forward and rearward ends in pivoting fashion;

a pair of cylindrical mounting posts affixed to said lower receiver for engaging said pins; and upon an upwardly displaceable follower associated with a magazine which is secured to the well being adapted to elevate into contact with said linkage at a location offset from a pivot axis established between said pins, a flattened shoulder projecting from said stem actuating in a combined pivoting and elevating fashion and adapted to contact and elevate the bolt catch for intercepting the forwardly displacing bolt.

* * * * *